US007089940B2

(12) United States Patent
Kellstrŏm

(10) Patent No.: US 7,089,940 B2
(45) Date of Patent: Aug. 15, 2006

(54) BALANCED VALVE DEVICE AND BREATHING APPARATUS COMPRISING SUCH VALVE DEVICE

(75) Inventor: Anders Kellstrŏm, Lerum (SE)

(73) Assignee: Poseidon Industri AB, Västra Frölunda (SE)

( * ) Notice: Subject to any disclaimer, the term of this patent is extended or adjusted under 35 U.S.C. 154(b) by 0 days.

(21) Appl. No.: 10/492,029

(22) PCT Filed: Oct. 11, 2002

(86) PCT No.: PCT/SE02/01858

§ 371 (c)(1),
(2), (4) Date: Jun. 21, 2004

(87) PCT Pub. No.: WO03/033076

PCT Pub. Date: Apr. 24, 2003

(65) Prior Publication Data

US 2004/0206357 A1 Oct. 21, 2004

(30) Foreign Application Priority Data

Oct. 18, 2001 (SE) ..... 0103478

(51) Int. Cl.
*A62B 9/02* (2006.01)

(52) U.S. Cl. ..... 128/205.24; 128/206.15; 128/204.29; 128/204.18; 128/201.28; 128/201.27; 128/204.26; 128/205.22; 128/205.16; 128/205.17; 128/204.25; 128/200.22

(58) Field of Classification Search ..... 128/205.24, 128/206.15, 204.29, 204.18, 201.28, 201.27, 128/204.26, 205.22, 205.18, 205.16, 204.25, 128/200.22
See application file for complete search history.

(56) References Cited

U.S. PATENT DOCUMENTS 2,929,376 A * 3/1960 James ..... 128/204.26
3,096,778 A * 7/1963 Arborelius et al. ..... 137/102

(Continued)

FOREIGN PATENT DOCUMENTS

EP 0807571 A1 11/1997

(Continued)

*Primary Examiner*—Henry Bennett
*Assistant Examiner*—Nihir Patel
(74) *Attorney, Agent, or Firm*—Sughrue Mion, PLLC

(57) ABSTRACT

A valve device, particularly for a breathing regulator for divers, including an inlet chamber which can be connected to a source of gas under super-atmospheric pressure, and an outlet chamber which is under a regulated pressure. A seating, which is movable under the influence of the super-atmospheric pressure and the regulated pressure, seals between the inlet chamber and the outlet chamber and has a through-passing passageway that interconnects the chambers. Also included is a valve body which is movably arranged in the seating such as to open and close the through-passing passageway in the seating. A servo element exerts on the valve body a force that depends on the position of the movable seating, so that varying force-influence on the valve body from the super-atmospheric pressure will be compensated for by a corresponding varying force from the servo element. This results in an essentially constant valve characteristic, while providing a mechanically simple solution at the same time.

8 Claims, 4 Drawing Sheets

U.S. PATENT DOCUMENTS 3,456,669 A * 7/1969 Lloyd ..... 137/84
4,172,467 A * 10/1979 Warnow ..... 137/494
4,178,961 A * 12/1979 Warncke ..... 137/495
4,276,877 A * 7/1981 Gdulla ..... 128/200.27
4,337,766 A * 7/1982 Feathers ..... 128/204.26
RE31,785 E * 1/1985 Netteland ..... 128/204.26
4,575,042 A * 3/1986 Grimland et al. ..... 251/46
4,606,339 A * 8/1986 Walther ..... 128/204.19
4,887,638 A 12/1989 Hellquist et al.
4,971,108 A * 11/1990 Gottlieb ..... 137/495
5,193,576 A 3/1993 Mosby
5,413,096 A * 5/1995 Hart ..... 128/205.24
5,839,436 A * 11/1998 Fangrow et al. ..... 128/205.24
5,960,793 A * 10/1999 Matsuoka et al. ..... 128/204.26
6,123,674 A * 9/2000 Rich ..... 600/529

FOREIGN PATENT DOCUMENTS

SE 461 427 B 8/1987

* cited by examiner

BALANCED VALVE DEVICE AND BREATHING APPARATUS COMPRISING SUCH VALVE DEVICE

FIELD OF INVENTION

The present invention relates to valve devices and then particularly to balanced valve devices for controlling the flow of pressurised breathable gas to breathing regulators. The invention also relates to such a breathing regulator.

DESCRIPTION OF THE BACKGROUND ART

Diving equipment includes a so-called breathing regulator which is connected to one or more diving tanks or their technical equivalence and which is intended to adjust the tank pressure to a predetermined regulated pressure. The breathing regulator is provided with a valve device to this end. FIG. 1 illustrates diagrammatically one such valve device constructed in accordance with known technology. As will be seen, the valve includes an inlet side 11, which is under tank pressure $P_{inlet}$, and an outlet side 12, which is under the regulated pressure $P_{outlet}$. A conical valve body 14 is movable in a seating 15. The outlet side 12 is delimited by a flexible diaphragm or membrane 16, which is connected to a spring 17 that exerts a spring force $F_{spring}$ on the diaphragm 16. Thus, one side of the diaphragm 16 is subjected to forces from the regulated pressure $P_{outlet}$, while the other side of the diaphragm is subjected to forces from the ambient pressure $P_{ambient}$. The spring force, together, e.g., with forces exerted by the diaphragm 16, acts/act on a rod 18 connected to the valve body and thus exerting a force $F_{rod}$ onto said body.

This known valve has the following modus operandi. Movement of the valve body 14 is determined by the forces to which it is subjected. These forces include (as shown in the figure) an upwardly directed force $F_{inlet}$ determined by the tank pressure. This force is counteracted essentially by downwardly acting forces $F_{outlet}$, which are comprised generally of the effect of the regulated pressure $P_{outlet}$ on the valve body and of the rod force $F_{rod}$. When a diver who has a nozzle connected to the outlet side inhales, therewith causing a decrease in the regulated pressure, the pressure on the diaphragm 16 decreases and the diaphragm then exerts an increasing force on the rod 18. The force $F_{rod}$ then increases and, in the case of a functioning valve, the valve body will be moved downwards, thereby allowing tank gas to flow in through the seating 15 until the regulated pressure has increased to an extent at which the valve body returns to the position shown in FIG. 1.

One problem with such known valve devices is that movement of the valve body is dependent on the tank pressure, which in the case of a full tank can correspond to a super atmospheric pressure of about 300 bar and may fall to close on 0 bar during use. This means, in turn, that the valve characteristic will vary, together with the regulated pressure.

Several solutions to this problem have been proposed. One example of these proposed solutions is illustrated in FIG. 2. The valve shown in FIG. 2 corresponds to the valve shown in FIG. 1 in many aspects, although in this latter case the homogenous valve body 14 has been replaced with a valve body 14' that includes a through-passing passageway **14*a*'. This passageway connects the outlet 12 with a space 19, which is sealed against the inlet 11 by means of an O-ring 20**. Consequently, those forces $F_{inlet}$ acting on the valve body from the inlet side have essentially no axial component, thereby providing a balanced valve that gives a regulated pressure generally independent of $P_{inlet}$.

The use of a valve body of this design, however, has the drawback that the sealing surface between the valve body and the seating ultimately tends to leak. There are several reasons for this. The fit between the hole and the cone of the valve body must be perfect—no irregulatories can be permitted. After having been in use for a longer period of time, the cone becomes damaged, in the form of scratches and ruts in the hole-defining edge and the cone, this damage contributing to seal leakage. Furthermore, the valve body must be straight, meaning that the body must be guided with utmost precision. The O-ring may begin to leak as a result of abrasion and other type of wear, thereby preventing achievement of the desired balancing effect and sealing effect.

These drawbacks associated with the use of a conical valve body are avoided when using a spherical sealing body. A spherical body is self-guiding, thereby obviating the need of the accurate guide required by a conical valve body.

It will be realised, however, that the balancing solution illustrated in FIG. 2 cannot be applied when a spherical body is used as a valve-closing means.

SUMMARY OF THE INVENTION

One object of the present invention is to provide a generally balanced valve device, in other words a valve device with which the pressure on the outlet side is held essentially constant regardless of the pressure on the inlet side.

The invention is based on the realisation that balancing of the valve device can be achieved by causing the seating on which the valve-closing member rests to move under the influence of the pressure on both the inlet side and the outlet side of said valve.

According to the invention, there is thus provided a valve device as defined in claim 1.

Also provided in accordance with the invention is a breathing regulator that includes such a valve device.

The inventive valve device and the inventive breathing regulator provide an essentially constant valve characteristic, while also affords a simple mechanical solution.

In one particularly preferred embodiment, a spherical body, or ball, is used as a valve-closing member. The valve-closing member is thus beneficially self-guiding.

Other preferred embodiments are defined in the dependent Claims.

BRIEF DESCRIPTION OF THE DRAWINGS

The invention will now be described in more detail by way of example and also with reference to the accompanying drawings, in which.

DESCRIPTION OF THE PREFERRED EMBODIMENT

A preferred embodiment of an inventive valve device and an inventive breathing regulator will now be described, first with reference to FIG. 3. It will be noted that the directions mentioned in the description, such as up, down, etc., refer only to those directions shown in the figures and shall not therefore be considered to limit the scope of the invention when interpreting the accompanying claims.

Figure 1:
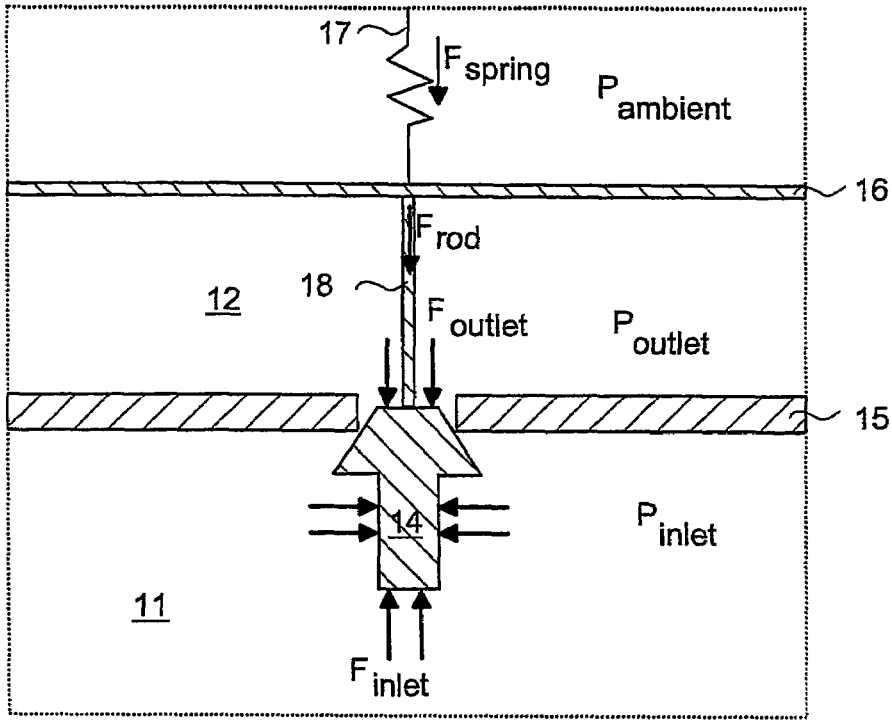
fig. 1 (Prior Art)
FIG. 1 is a diagrammatic illustration of an unbalanced valve device according to prior art.
Figure 3:
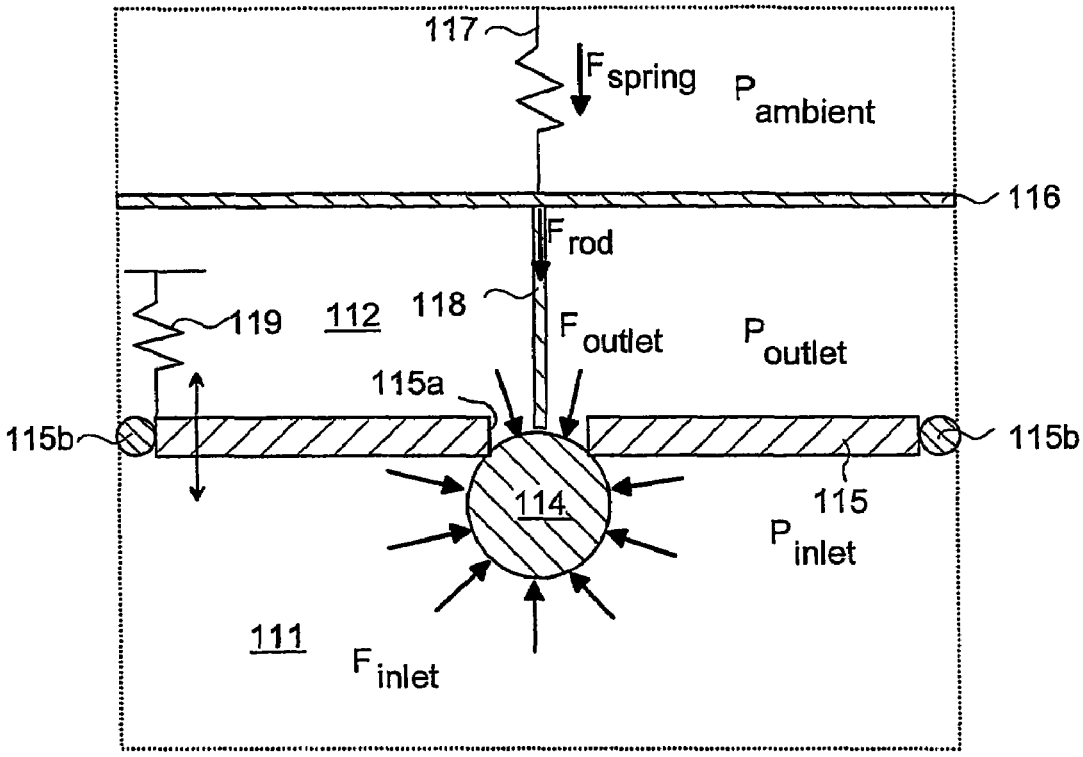
FIG. 3 is a diagrammatic illustration of a valve device according to the invention.

FIG. 3 is a principle diagram of an inventive valve device. The valve device includes an inlet side 111, an outlet side 112, a diaphragm or membrane 116, a diaphragm spring 117, and a rod 118. These valve components correspond to the valve components shown in FIG. 1. The valve device also includes a valve-closing body in the form of a ball 114, which rests over an opening 115*a* in a seating 115. Distinct from the seating used in said known valve technology, the seating 115 can move up and down, as indicated by the double-headed arrow in FIG. 3. Sealing between the inlet and the outlet sides is achieved by means of an O-ring 115*b*, which abuts the movable seating, and a regulator housing (not shown in FIG. 3 ). The seating spring 119 is connected to the seating. Thus, the seating is able to move in response to a difference in the pressure between the inlet side 111 and the outlet side 112, and also in accordance with the spring characteristic of the spring 119. In order to obtain said essentially balanced valve function, it is necessary that the following ratios are fulfilled between relevant areas and spring characteristics:

$$k(119) = k(117) \cdot \frac{A(115a) - A(115b)}{A(115b)}$$

where k(119)=the stiffness of the seating spring 119;

k(117)=the stiffness of the diaphragm spring 117;

A(115*a*)=the area of the opening 115*a* in the seating 115; and

A(115*b*)=the area sealed by the O-ring 115*b*.

It should be noted that this is a somewhat simplified relationship that does not take, e.g., O-ring friction and sealing force into account.

Because the seating is movable, the force of the spring will vary in accordance with the position of the seating, when the ball rests in the seating. This enables changes in gas pressure on the inlet side to be compensated for in respect of "automatically" changed spring forces. For instance, if the tank pressure should decrease, resulting in a smaller upwardly acting force $F_{inlet}$, the seating 115 will move downwards in the figure. The spring is extended as a result of this downward movement of the seating, resulting in a decrease in the downwardly acting force $F_{rod}$. The person skilled in this particular technical field will be able to readily dimension the regulator components so that the changes in upwardly directed and downwardly directed forces on the ball will cancel each other out, thereby achieving balancing of the valve device; see the above formula.

An embodiment of a breathing regulator 100 that includes an inventive valve device will now be described with reference to FIGS. 4–7. The regulator comprises a housing 101 whose interior is sealed against the surroundings by means of the diaphragm 116. The housing includes a lid or cover 102, which functions as a counter-pressure means for the spring 117. A tank coupling 103 is also sealingly connected to the housing.

The breathing regulator includes an inlet side 111 which is adapted for connection to one or more diving tanks (not shown) and an outlet side 112 adapted for connection to a breathing nozzle (not shown). The inlet and outlet sides are mutually separated by a valve seating 115. The valve seating is able to move up and down and is sealed against the housing 101 by means of an O-ring 115*b*. The seating has an axially through-passing opening 115*a* of circular cross-section, said opening forming a connecting passageway between the inlet and outlet sides. Movement of the seating is regulated by a spring 119.

A ball 114 functions as a valve-closing body. The ball rests in the seating 115 and closes the passageway 115*a* in the position shown in FIG. 4. The ball acts on a rod 118 which, in turn, acts on the diaphragm 116 and thereby on a pressure plate 120 which is spring-biased downwards by means of the spring 117. The rod is mounted in a holder 121 by means of a slide bearing (not shown). The function of the holder 121 is thus to guide the rod 118, among other things, and also to hold the seating spring 119. The holder is also designed to limit upward movement of the seating to an upper end position. The space in which the pressure plate 120 is disposed is divided by the flexible diaphragm 116 into a lower chamber 123*a*, which is in connection with the outlet side 112, and an upper chamber 123*b*.

The valve seating is comprised essentially of metal, although it has a plastic coating on the surface that abuts the ball. The ball is made of steel or a ceramic material. In the case of the preferred embodiment, the diaphragm 116 is a roll diaphragm.

Figure 4:
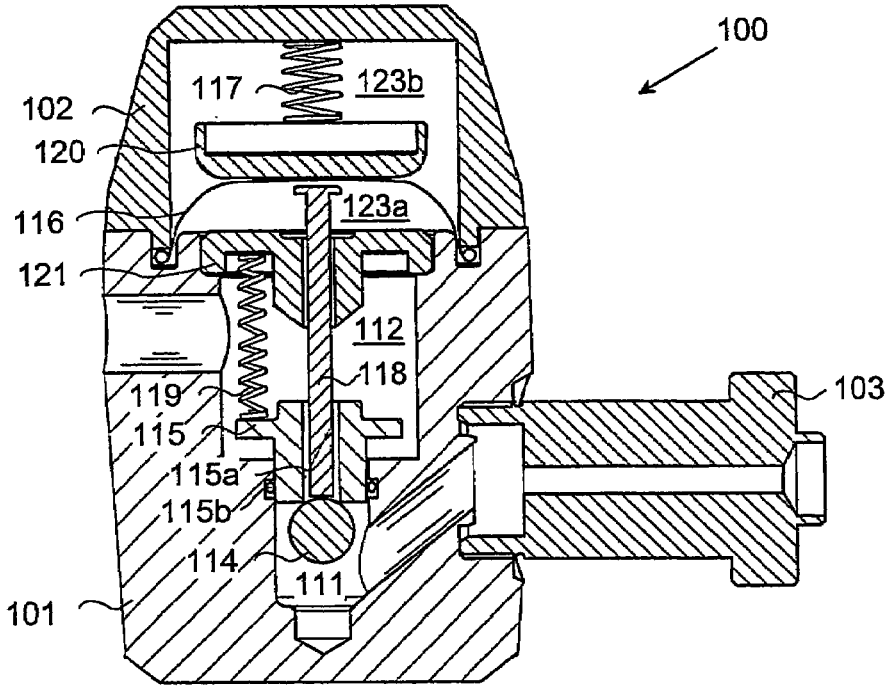
FIG. 4 illustrates a breathing regulator that includes an inventive valve device, said valve being closed when high pressure prevails on the inlet side.
Figure 5:
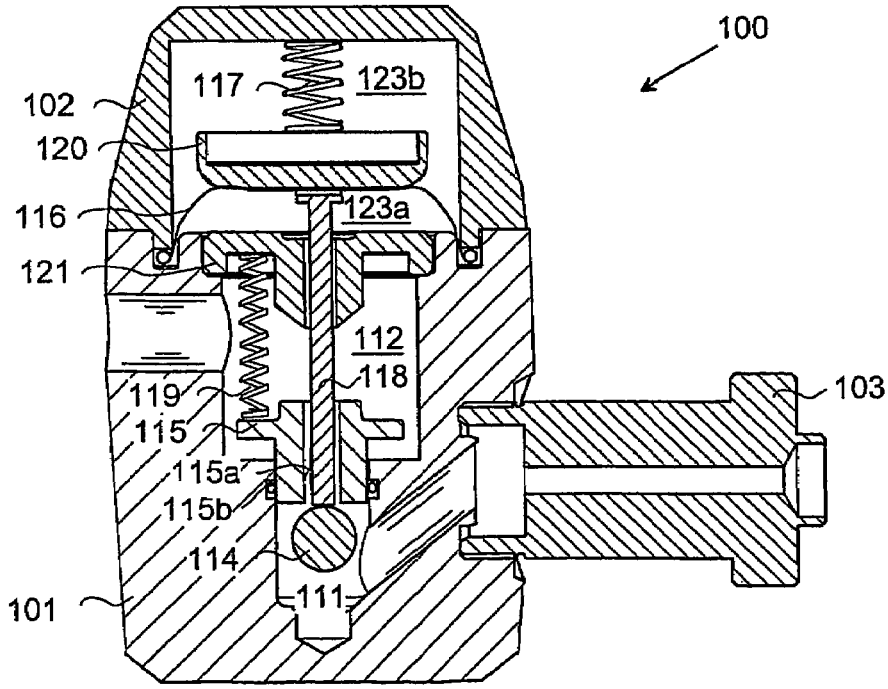
FIG. 5 shows the breathing regulator of FIG. 4 with the valve open.
Figure 6:
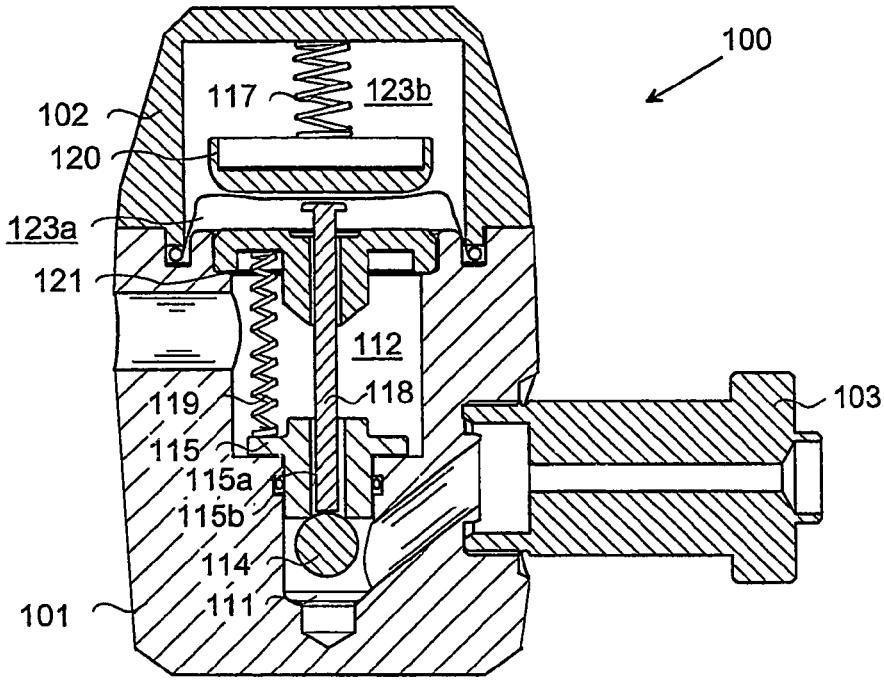
FIG. 6 shows the breathing regulator of FIG. 4 with the valve closed when low pressure prevails on the inlet side.
Figure 7:
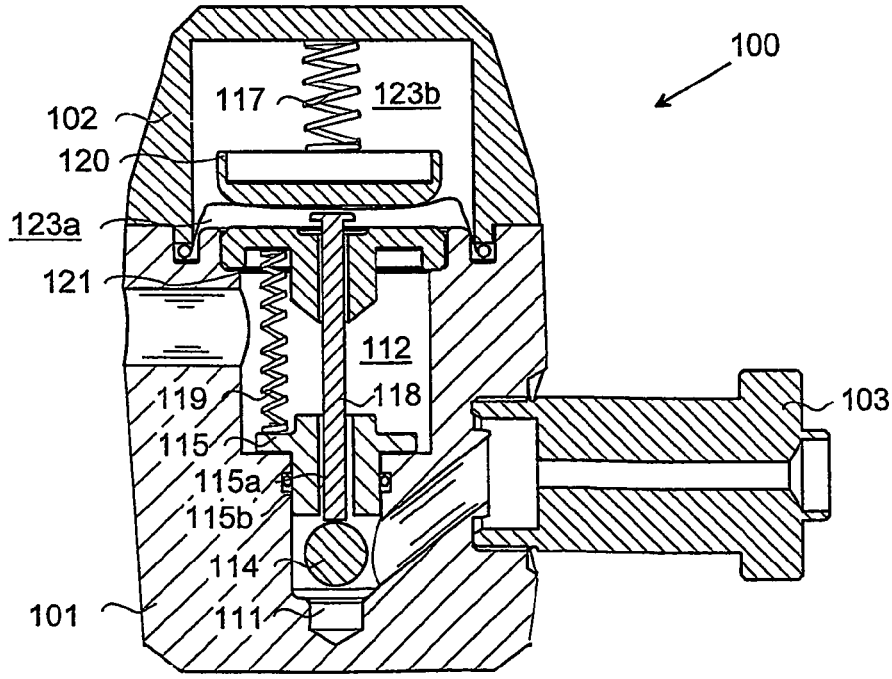
FIG. 7 shows the breathing regulator of FIG. 6 with the valve open.

FIG. 4 shows the breathing regulator 100 in a closed state, with high pressure on the inlet side, wherewith it will be seen that the seating 115 has been displaced slightly upwards away from the bottom of the chamber 112. This corresponds to the situation when a dive commences. FIG. 5 shows the breathing regulator in the same situation, but with inhalation when the valve device is open. Inhalation empties the inlet side of air, and therewith also the lower chamber 123*a*, causing the pressure in the chamber to fall. This causes the flexible diaphragm 116 to move downwards and thereby exert force on the rod 118, which, in turn, acts downwardly on the ball 114. Because the downwardly acting forces on the ball in this position exceed the upwardly directed forces, the ball will leave its sealing placement in the seating and allow air to pass through the passageway 115*a*. This state continues until the upwardly directed forces acting on the ball exceed the downwardly acting forces, in other words when the pressure on the inlet side, and therewith in the lower chamber 123*a*, has increased to a desired regulated pressure. The diaphragm is therewith caused to return to the position shown in FIG. 4. The super-atmospheric pressure in the diving tank falls after being used for awhile and therewith also the pressure on the inlet side 111. The regulated pressure on the outlet side 112, however, shall remain at the desired regulated pressure. This means that the seating 115 gradually moves down and finally takes the lower end position shown in FIGS. 6 and 7. This means, in turn, that the forces exerted by the rod 118 on the ball become smaller, which balances the decreasing forces resulting from the drop in pressure in the diving tank. In other respects, opening and closing of the valve in the position shown in FIGS. 6 and 7 take place precisely as in the situation described above with reference to FIGS. 4 and 5.

Figure 2:
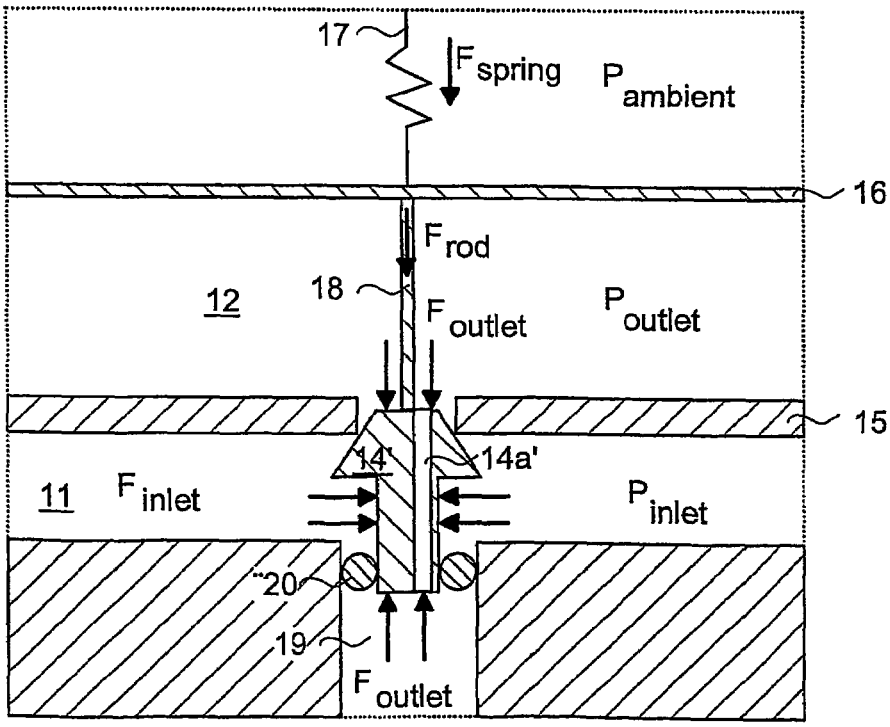
fig. 2 (Prior Art)
FIG. 2 is a diagrammatic illustration of a balanced valve device according to prior art.

The inventive breathing regulator achieves the same valve balancing effect as that earlier achieved with the use of an O-ring sealed conical valve body as a valve-closing means, see FIG. 2. At the same time, there are obtained those advantages that are afforded by the use of a ball as a valve-closing body, such as a self-guiding effect.

Although the invention has been described with reference to a preferred embodiment of a valve device and a preferred embodiment of a breathing regulator, the person skilled in this particular technical field will be aware that these embodiments can be varied or modified within the scope of the accompanying Claims. For example, the valve seating may consist entirely of metal, and the ball may be made of plastic. To avoid wear, the edge surface of the passageway 115*a* that functions as an abutment surface on the seating 115 against the ball 114 may be coated with a plastic material.

In use, the ball 114 rests against the rod 118. In order to counteract the force of gravity on the ball, and therewith ensure that the ball will not fall to the bottom at a given attitude on the regulator—which could cause the ball to be wrongly positioned in the seating as a result, e.g., of a very slow or very fast increase of $P_{inlet}$—a spring (not shown) may be included between the ball and the bottom of the regulator housing. In such case, the spring shall be sufficiently weak to render its force addition negligible, or, alternatively, this force addition can be included when dimensioning the regulator.

The seating has been shown to be movable under the effect of the pressure on the inlet and outlet sides. For obtaining desired movement characteristics, there has been described a seating spring 119. Alternatively, several springs, for instance helical springs or cup springs, may be arranged between the seating and the holder 121. Alternatively, the intrinsic springiness of the seating, i.e. its ability to bend under pressure, may be utilised to obtain the desired movement of the seating. In this case, the function of the seating spring 119 is replaced by a fixedly mounted seating in which outward bending or compression of the seating material replaces the function of the seating spring 119.

There has been shown a spring 117 that acts on the pressure plate 120. Alternatively, the forces exerted by the diaphragm 116 may replace the forces exerted by the spring, therewith enabling the spring to be omitted.

Although a ball has been described as a valve-closing body, it will be understood that a movable seating can also be used together with a conical body as a valve-closing means.

The servo device may include a plunger instead of a flexible diaphragm.

Although the valve device described is primarily intended for divers, it will be understood that similar applications are also encompassed by the inventive concept, such as in connection with equipment for smoke divers, medical care equipment, etc.

The invention claimed is:

1. A valve device particularly for a breathing regulator for divers, comprising an inlet chamber connectable to a source of gas under super-atmospheric pressure ($P_{inlet}$);

an outlet chamber that is under a regulated pressure ($P_{outlet}$);

a seating sealingly arranged between said inlet chamber and said outlet chamber, said seating including a through-passing passageway that interconnects said inlet chamber and said outlet chamber;

a valve element which is movably arranged in said seating and which is adapted to open and close said passageway, said valve element being subjected to forces that include forces from said super-atmospheric and regulated pressures; and a servo element adapted to regulate said valve element, wherein said seating is movable under the influence of said super-atmospheric pressure and said regulated pressure, wherein said servo element exerts on said valve element a force that depends on the position of said movable seating, so that varying force-influenced actuation of said valve element by said super-atmospheric pressure is compensated for by a corresponding varying force from said servo element;

wherein said regulated pressure is held generally constant regardless of said super-atmospheric pressure, and wherein said valve element is a ball.

2. A valve device according to claim 1, in which said servo element includes a flexible diaphragm that is operative to be influenced by said regulated pressure ($P_{outlet}$); and a rod connected to said diaphragm;

wherein said rod exerts on said valve element in the seating a force that depends on the difference between an ambient pressure ($P_{ambient}$) and said regulator pressure ($P_{outlet}$).

3. A valve device according to claim 1, wherein the seating is comprised of metal.

4. A valve device according to claim 3, in which an edge surface of said passageway functioning as an abutment surface on said seating against said valve-closing body is coated with a plastic material.

5. A valve device according to claim 4, in which a function of the spring is replaced by a fixedly mounted seating, wherein outward bending or compression of the seating material replaces the function of the spring.

6. A valve device according to claim 1, comprising a spring in connection with said seating.

7. A valve device according to claim 1, in which the valve closing body is comprised of any of plastic and metal.

8. A breathing regulator having a housing and including a valve device according to claim 1.

* * * * *